US008394561B2

(12) United States Patent
Wosnick et al.

(10) Patent No.: US 8,394,561 B2
(45) Date of Patent: Mar. 12, 2013

(54) COLORED TONERS

(75) Inventors: Jordan H. Wosnick, Toronto (CA); Suxia Yang, Mississauga (CA); Richard P. N. Veregin, Mississauga (CA); Karen A. Moffat, Brantford (CA)

(73) Assignee: Xerox Corporation, Norwalk, CT (US)

( * ) Notice: Subject to any disclaimer, the term of this patent is extended or adjusted under 35 U.S.C. 154(b) by 424 days.

(21) Appl. No.: 12/505,683

(22) Filed: Jul. 20, 2009

(65) Prior Publication Data

US 2011/0014559 A1 Jan. 20, 2011

(51) Int. Cl.
*G03G 9/09* (2006.01)
*G03G 5/12* (2006.01)

(52) U.S. Cl. ..... 430/107.1; 430/137.14

(58) Field of Classification Search ..... 430/107.1, 430/108.21, 109.1, 109.4, 137.12
See application file for complete search history.

(56) References Cited

U.S. PATENT DOCUMENTS 3,590,000 A 6/1971 Palermiti et al.
3,655,374 A 4/1972 Palermiti et al.
3,720,617 A 3/1973 Chatterji et al.
3,847,604 A 11/1974 Hagenbach et al.
3,944,493 A 3/1976 Jadwin et al.
3,983,045 A 9/1976 Jugle et al.
4,007,293 A 2/1977 Mincer et al.
4,079,014 A 3/1978 Burness et al.
4,295,990 A 10/1981 Verbeek et al.
4,394,430 A 7/1983 Jadwin et al.
4,560,635 A 12/1985 Hoffend et al.
4,935,326 A 6/1990 Creatura et al.
4,937,166 A 6/1990 Creatura et al.
5,236,629 A 8/1993 Mahabadi et al.
5,290,654 A 3/1994 Sacripante et al.
5,302,486 A 4/1994 Patel et al.
5,330,874 A 7/1994 Mahabadi et al.
5,723,245 A 3/1998 Bertrand et al.
5,734,800 A 3/1998 Herbert et al.
5,866,288 A 2/1999 Ciccarelli et al.
6,004,714 A 12/1999 Ciccarelli et al.
6,063,827 A 5/2000 Sacripante et al.
6,066,421 A 5/2000 Julien et al.
6,190,815 B1 2/2001 Ciccarelli et al.
6,593,049 B1 7/2003 Veregin et al.
6,756,176 B2 6/2004 Stegamat et al.
6,809,837 B1 10/2004 Mestha et al.
6,830,860 B2 12/2004 Sacripante et al.
7,123,380 B2 10/2006 Van de Capelle
7,375,851 B2 5/2008 Mestha
2004/0058268 A1 3/2004 Veregin et al.
2004/0063018 A1* 4/2004 Silence et al. ..... 430/108.4
2006/0222991 A1 10/2006 Sacripante et al.
2008/0153027 A1* 6/2008 Veregin et al. ..... 430/113
2009/0028614 A1 1/2009 Kerxhalli et al.

* cited by examiner

*Primary Examiner* — Jonathan Jelsma
(74) *Attorney, Agent, or Firm* — MDIP LLC

(57) ABSTRACT

The present disclosure provides violet toners and methods for their production. In embodiments, methods of the present disclosure include systems which may be utilized to predict the color properties of a violet toner, thereby permitting adjustment of the pigment loading and/or target mass per unit area.

20 Claims, 6 Drawing Sheets

10

$$L^* = 67.367-4365V-4979B+201.7K+1.681\times10^5VB-1.388\times10^7VBK+1.007\times10^5V^2+4.199\times10^5B^2$$
$$a^* = 21.842+4373V-4563B-2.863\times10^4K+1.209\times10^5VB+8.018\times10^6VK+6.373\times10^7VBK-1.414\times10^5V^2+3.513\times10^5B^2+2.249\times10^7K^2$$
$$b^* = -41.530-3124V-5184B+2.662\times10^4K+1.836\times10^5VB-8.760\times10^5VK-5.078\times10^7VBK+9.723\times10^4V^2+2.609\times10^5B^2$$
$$C = 46.134-5161V+1585B-4.053\times10^4K-8.760\times10^5VB+1.165\times10^6VK+8.169\times10^7VBK-1.637\times10^5V^2+2.347\times10^7K^2$$
$$h = 301.82+1113V-4746B-2129K+1.476\times10^6VB-2.449\times10^6BK+1.489\times10^9VBK-3.802\times10^4V^2+3.271\times10^5B^2+8.345\times10^6K^2$$

FIG. 1

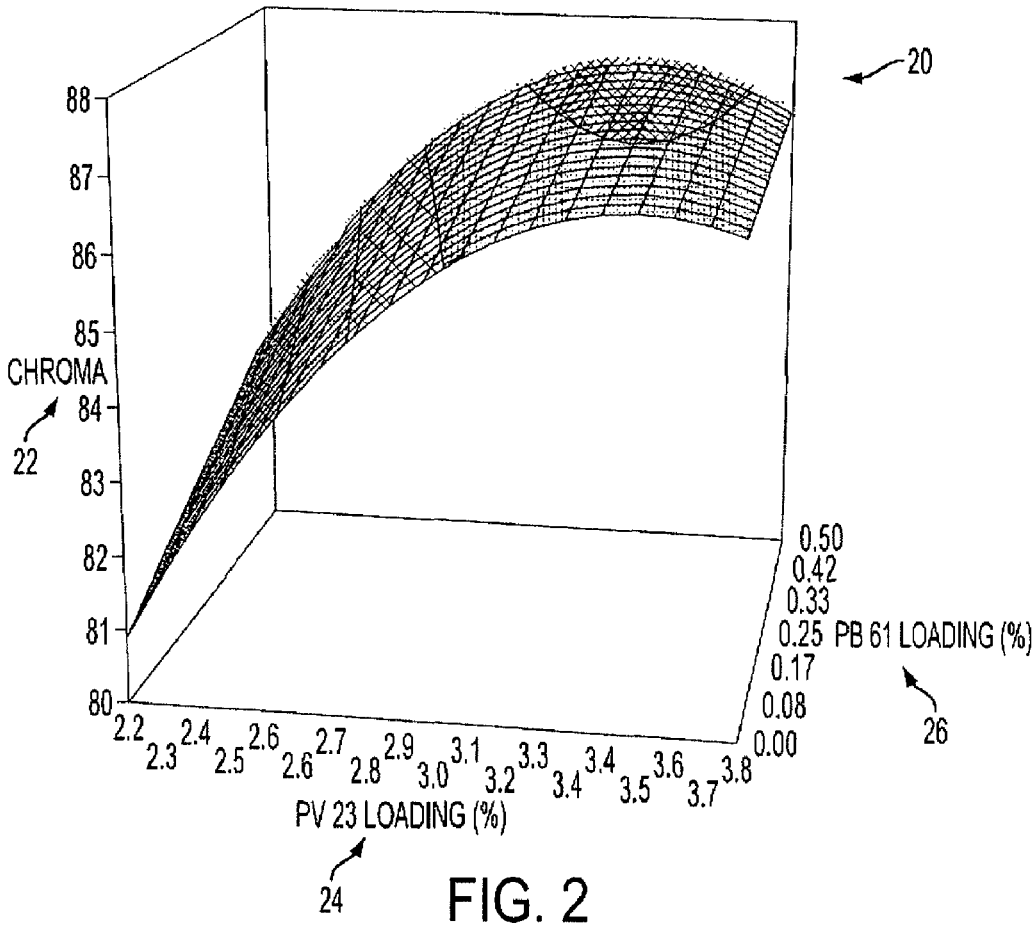

FIG. 2

$$L^* = 67.944 - 3.621\,B' - 150.875\,m - 6.344\,B'm + 124.104\,m^2$$
$$a^* = 18.047 - 4.650\,B' + 131.326\,m - 18.450\,B'm + 3.435\,B'^2 - 130.027\,m^2$$
$$b^* = -34.019 - 22.302\,B' - 118.784\,m + 27.313\,B'm + 9.787\,B'^2 + 119.330\,m^2$$
$$C = 38.210 + 15.099\,B' + 173.127\,m - 33.594\,B'm - 5.122\,B'^2 - 172.598\,m^2$$
$$h = 301.867 - 11.617\,B' + 27.151\,m + 5.823\,B'^2 - 26.152\,m^2$$

80

$b' = B'/100 \times 0.456$
$v' = 3.46\% \times m$

OR $B' = 100 \times b'/0.456 = 219.3 \times b'$
$m = v'/3.46\% = 28.9 \times v'$

FIG. 8

90

$L^* = 67.944 - 794.085b' - 4360.288v' - 40206.81b'v' + 103652.9v'^2$
$a^* = 18.047 - 1019.745b' + 3795.321v' - 116931.9b'v' + 165197.7b'^2 - 108599.9v'^2$
$b^* = -34.019 - 4890.829b' - 3432.858v' + 173103.5b'v' + 470681.2b'^2 + 99665.6v'^2$
$C = 38.210 + 3311.211b' + 5003.37v' - 212911b'v' - 246329.7b'^2 - 144155.6v'^2$
$h = 301.867 - 2547.608b' + 784.664v' + 280042.6b'^2 - 21842.4v'^2$

FIG. 9

COLORED TONERS

BACKGROUND

The present disclosure provides an approach for producing colored toner compositions and, in embodiments, to a system and method for predicting color properties of toner compositions.

In today's business and scientific world, color has become essential as a component of communication. Color facilitates the sharing of knowledge and ideas. Companies involved in the development of digital color print engines are continuously looking for ways to improve the image quality of their products. One of the elements that affects image quality is the ability to consistently produce the same image on a printer from one day to another, from one week to the next, month after month. Users have become accustomed to printers and copiers that produce high quality color and gray-scaled output. Users now expect to be able to reproduce a color image with consistent quality on any compatible printing device, including another device within an organization, a device at home, or a device used anywhere else in the world.

Color images are commonly represented as one or more separations, each separation comprising a set of color density signals for a single primary or secondary color. Color density signals are commonly represented as digital gray or contone pixels, varying in magnitude from a minimum to a maximum, with a number of gradients corresponding to the bit density of the system. Thus, a common 8-bit system provides 256 shades of each primary color. A color can therefore be considered the combination of magnitudes of each pixel, which when viewed together, present the combination color.

CMYK is a color model in which all colors are described as a mixture of four process colors (i.e., cyan, magenta, yellow, and black). CMYK is the standard color model used in offset printing for full-color documents. Because such printing uses inks of these four basic colors, it is often called four-color printing and is a subtractive color model. The CMYK model works by partially or entirely masking certain colors on the typically white background (that is, absorbing particular wavelengths of light). Such a model is called subtractive because inks "subtract" brightness from white. In additive color models such as RGB (i.e., red, green, blue), white is the "additive" combination of all primary colored lights, while black is the absence of light. In the CMYK model, it is just the opposite. In other words, white is the natural color of the paper or other background, while black results from a full combination of colored inks. To save money on ink, and to produce deeper black tones, unsaturated and dark colors are produced by substituting black ink for the combination of cyan, magenta and yellow.

There are different ways of representing color. One way color is described consists of the following parameters: hue, lightness and saturation. Hue represents the actual color wavelength (red, blue, etc.); lightness corresponds to the white content; while saturation captures the richness or amplitude in color. Another way of describing color uses the three dominant primary colors red, blue and green (RGB). By combining these primary colors, in different intensities, most colors visible to humans can be reproduced. Monitors and scanners use the additive RGB color process. Printers use the subtractive CMYK color process based on light reflected from inks coated on a substrate. The color representations described above fail to reproduce color predictably because they are observer or device dependent.

Moreover, while the CMYK color space is the standard color space used by production printers, the Red-Green-Blue (RGB) color space is a personal computer's native color space. As a result, display devices generally use a different color model, namely the RGB model. One of the most difficult aspects of desktop publishing in color is color matching, which is properly converting the RGB colors into CMYK colors so that what gets printed looks the same as what appears on the monitor.

Both RGB and CMYK color spaces are device-dependent color spaces; i.e., the colors rendered depend on the device that produces the colors. For example, the colorimetric attributes produced by a scanner vary from the colorimetric attributes visible on a monitor since a scanner uses a CCD (charge coupled device) array to capture colors, while a monitor produces colors from light-emitting phosphors. Additionally, the process of converting an image from the RGB color space to the CMYK color space generally compresses the colors into a smaller range.

Improved methods for producing colored toners, including systems that are not device-dependent, remain desirable.

SUMMARY

The present disclosure provides processes for producing colored toner compositions and toners produced by such methods. In embodiments, the present disclosure provides a violet toner including at least one resin, an optional wax, and a colorant system including a violet pigment such as Pigment Violet 23, Pigment Violet 3, and combinations thereof, in combination with a blue pigment such as Pigment Blue 61, Pigment Blue 15:3, and combinations thereof, wherein the violet toner matches the color of Pantone violet within a human perception limit ($\Delta E_{2000}$) of less than about 3.

In embodiments, the present disclosure provides a violet toner including at least one resin including at least one amorphous polyester resin in combination with at least one crystalline polyester resin, a wax, and a colorant system including a violet pigment such as Pigment Violet 23, Pigment Violet 3, and combinations thereof, in combination with a blue pigment such as Pigment Blue 61, Pigment Blue 15:3, and combinations thereof, wherein the violet toner matches the color of Pantone violet within a human perception limit ($\Delta E_{2000}$) of less than about 3.

A method of the present disclosure includes contacting at least one resin and at least one surfactant to form an emulsion; contacting the emulsion with an optional wax, and a colorant system comprising a violet pigment such as Pigment Violet 23, Pigment Violet 3, and combinations thereof, present in an amount of from about 0.5 to about 10 percent by weight of the toner, in combination with a blue pigment such as Pigment Blue 61, Pigment Blue 15:3, and combinations thereof, present in an amount of from about 0 to about 10 percent by weight of the toner, to form a primary slurry; aggregating the at least one resin and the colorant system with an aggregating agent to form aggregated particles; coalescing the aggregated particles to form toner particles; and recovering the toner particles, wherein the violet toner matches the color of Pantone violet within a human perception limit ($\Delta E_{2000}$) of less than about 3.

BRIEF DESCRIPTION OF THE DRAWINGS

Various embodiments of the present disclosure will be described herein below with reference to the figures wherein:

FIG. 1 is a set of equations that represent predicted color values for violet toners in accordance with the present disclosure using a wet-deposition technique;

FIG. 2 is a schematic diagram of a three-dimensional representation of the relationship of the CIELAB chroma (C) to loadings of Pigment Violet 23 and Pigment Blue 61 in a toner in accordance with the present disclosure, deposited at 0.45 $mg/cm^2$;

FIG. 8 is a set of equations that represent unit interconversion for data analysis of the set of equations of FIG. 4;

FIG. 9 is a set of equations that represent predicted color values for violet toners in accordance with the present disclosure, based on pigment densities using xerographic printing;

Figure 3:
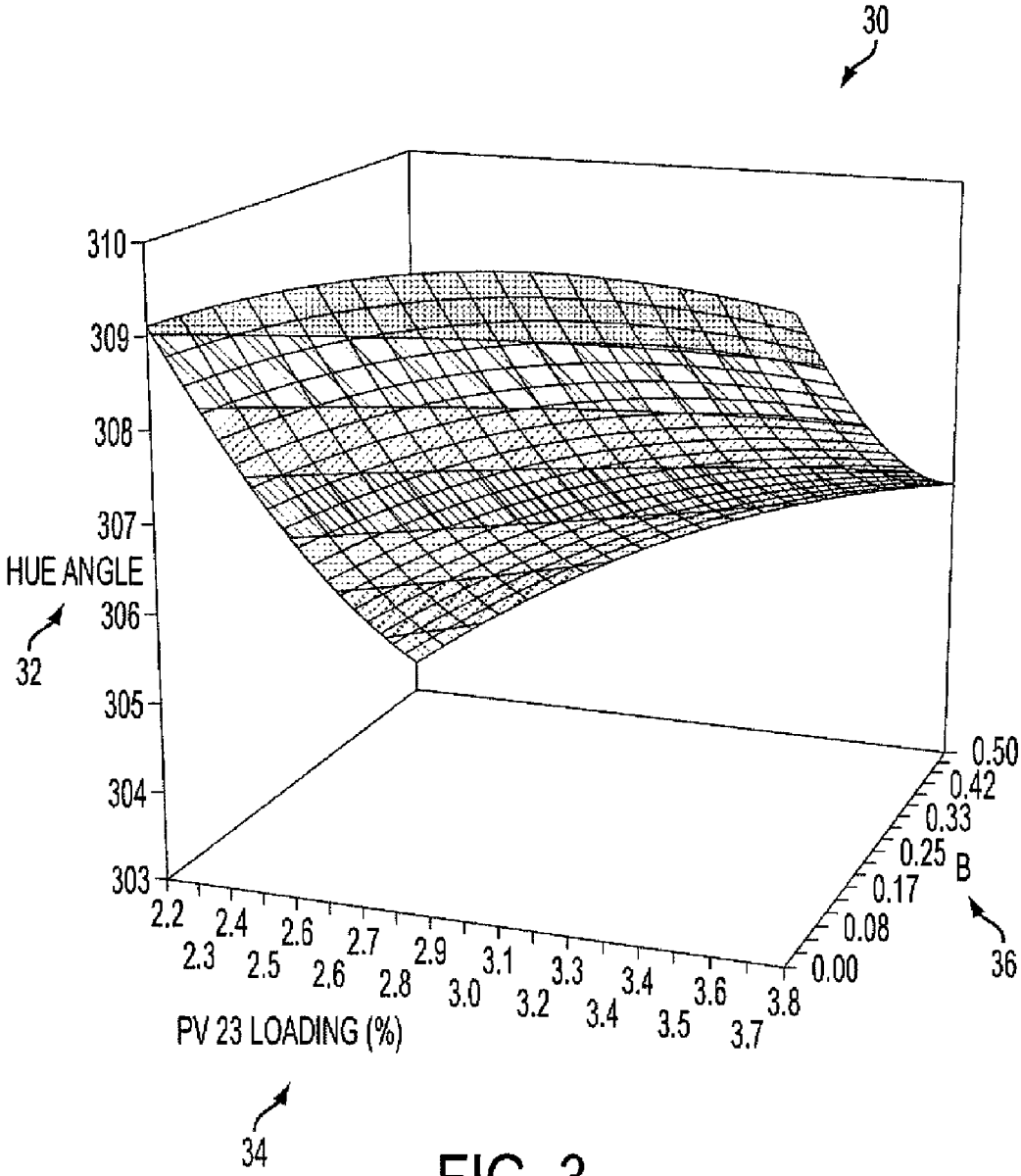
FIG. 3 is a schematic diagram of a three-dimensional representation of the relationship of the CIELAB hue (h) to loadings of Pigment Violet 23 and Pigment Blue 61 in a toner in accordance with the present disclosure, deposited at 0.45 $mg/cm^2$.

It is noted that the drawings of the present disclosure are not to scale. The drawings are intended to depict only typical embodiments of the present disclosure, and therefore should not be considered as limiting the scope of the present disclosure. In the drawings, like numbering represents like elements between the drawings.

DETAILED DESCRIPTION OF THE PREFERRED EMBODIMENTS

The present disclosure provides toners and systems which may include such toners. In embodiments, a toner of the present disclosure may include a violet toner suitable for use in a color printing system, as an additional colorant besides a cyan, magenta, yellow and black.

The functional models presented in the present disclosure use a device independent color space to consistently track a set of target colors. L*, a*, b* are the CIE (Commission Internationale de L'eclairage) color standards utilized in the modeling. L* defines lightness, a* corresponds to the red/green value and b* denotes the amount of yellow/blue, which corresponds to the way people perceive color. A neutral color is a color where a*=b*=0.

Resin

Toners of the present disclosure may include any latex resin suitable for use in forming a toner. Such resins, in turn, may be made of any suitable monomer. Suitable monomers useful in forming the resin include, but are not limited to, styrenes, acrylates, methacrylates, butadienes, isoprenes, acrylic acids, methacrylic acids, acryloritriles, diols, diacids, diamines, diesters, diisocyanates, combinations thereof, and the like. Any monomer employed may be selected depending upon the particular polymer to be utilized.

In embodiments, the resin may be a polymer resin including, for example, resins based on styrene acrylates, styrene butadienes, styrene methacrylates, and more specifically, poly(styrene-alkyl acrylate), poly(styrene-1,3-diene), poly (styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3 -diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In other embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylenepropylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula (I):

(I)

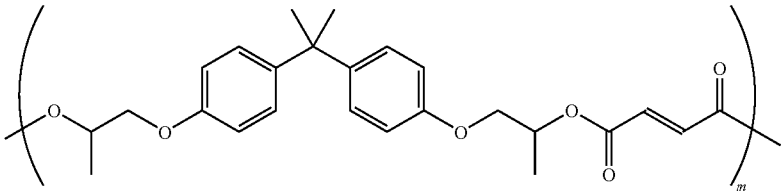

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL2 from Kao Corporation, Japan, and EM181635 from Reichhold, Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

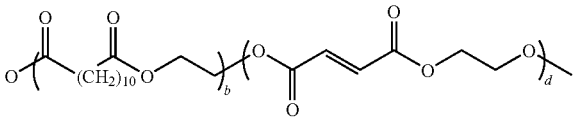

wherein b is from about 5 to about 2000 and d is from about 5 to about 2000.

In embodiments, a suitable crystalline resin utilized in a toner of the present disclosure may have a molecular weight of from about 10,000 to about 100,000, in embodiments from about 15,000 to about 30,000.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

As noted above, in embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, or preferably from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75, in some embodiments from about 5:95 to about 15:95.

Toner

The resins described above, in embodiments a combination of polyester resins, for example a low molecular weight amorphous resin and a crystalline resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Violet Toner

In embodiments, toners of the present disclosure include violet toners. Violet toners of the present disclosure may include a colorant system including more than one color. In the present disclosure, a model is provided that can be used to predict the pigment concentrations required to produce a given set of CIELAB values, in embodiments, for a violet toner. Such a model can then be used to derive the exact formulation needed to match the PANTONE® violet color standard, or closely related shades of violet.

Color accuracy is generally quantified using the color error factor $\Delta E_{2000}$, which converts CIELAB color data (L*, a* and b*) for a pair of colors into a single number expressing the "distance" between these colors. The formula for $\Delta E_{2000}$ uses weighting to compensate for variation in the ability of the human eye to discriminate closely related shades within particular regions of the visible spectrum. When $\Delta E_{2000}<3$, the two colors are generally accepted to be indistinguishable to the human eye.

Prior to describing the present disclosure in further detail, it will first be helpful to define various terms that will be used throughout the following discussion. For example:

The term "color" may refer to the representation of a vector of values which characterize all or a portion of the image intensity information. It could represent red, green, and blue intensities in an RGB color space or a single luminosity in a Grayscale color space. Alternatively, it could represent alternative information such as CMY, CMYK, PANTONE®, x-ray, infrared, and gamma ray intensities from various spectral wavelength bands.

Unless otherwise indicated, all numbers expressing quantities and conditions, and so forth used in the specification and claims are to be understood as being modified in all instances by the term "about." In this application, the use of the singular includes the plural unless specifically stated otherwise. In this application, the use of "or" means "and/or" unless stated otherwise. Furthermore, the use of the term "including," as well as other forms, such as "includes" and "included," is not limiting.

Prior to describing the present disclosure in further detail, it will first be helpful to note that the present disclosure describes two sets of equations that relate the CIELAB values of a violet toner to its pigment composition. Different relationships exist depending on the nature of the substrate (e.g., smooth vs. rough) and the toner deposition method (e.g., xerographic vs. filtration). These relationships were derived through statistical analysis of color samples produced by blending toners for the wet-deposition technique and blending pigments in the same toners for xerographic printing.

The present disclosure further proposes a violet toner formulation matching the color of PANTONE® violet to within a $\Delta E_{2000}$ of 3, where the pigments include at least PV23 and PB 61, and where the PV23 and PB61 pigment loadings and print toner mass per unit area (TMA) of the violet are described by a number of equations for at least either a*, b*, and L*, or C and h, or all of a*, b*, L*, C, and h. Such equations are described below with reference to FIGS. 1, 4, 8, and 9.

In embodiments, for example, the colorant utilized to provide a violet toner may include at least one violet pigment in combination with at least one blue pigment, and optionally at least one black pigment. Suitable violet pigments for forming the violet toner include, but are not limited to, violet pigments such as Pigment Violet 23 (PV23), Pigment Violet 3 (PV 3), and combinations thereof. The violet pigment may be present in amounts of from about 0.5 percent by weight to about 10 percent by weight of the colorant system, in embodiments from about 1 percent by weight to about 8 percent by weight of the colorant system. The colorant system may also include a blue pigment. Suitable blue pigments include Pigment Blue 61 (PB61), Pigment Blue 15:3 (PB15:3), and combinations thereof, in amounts from about 0 percent by weight to about 10 percent by weight of the colorant system, in embodiments from about 0.1 percent by weight to about 5 percent by weight of the colorant system. As noted above, in embodiments a colorant system may also include a black pigment such as carbon black, magnetite, aniline black, manganese oxide, lamp black, iron oxide, combinations thereof, and the like. Where present, a black pigment may be present in an amount of from about 0 percent by weight to about 5 percent by weight of the colorant system, in embodiments from about 0.1 percent by weight to about 5 percent by weight of the colorant system.

The colorant system of the present disclosure may be present in a toner in an amount of from about 1 percent by weight to about 15 percent by weight of the toner, in embodiments from about 2 percent by weight to about 8 percent by weight of the toner.

Toners of the present disclosure may be able to obtain a target mass per area of from about 0.2 mg/cm$^2$ to about 1.5 mg/cm$^2$ in embodiments from about 0.3 mg/cm$^2$ to about 0.7 mg/cm$^2$.

The present disclosure further proposes a mathematical model that can be used to predict the color properties of a xerographic toner containing a given amount of Pigment Violet 23, Pigment Blue 61, and optionally carbon black at a specified toner mass-per-area (TMA) level. Several sets of equations are provided for both wet-deposition samples and xerographic prints.

Referring now to the drawing figures, in which like references numerals identify identical or corresponding elements, a system and method for dynamically predicting an analytical model for varying color properties of a plurality of toners, in embodiments a violet toner, will now be described in detail.

With reference to FIG. 1, a set of equations that represent predicted color values for violet toners using a wet-deposition technique, in accordance with the present disclosure is presented.

The set of equations 10 illustrate a relationship between Pigment Violet 23, Pigment Blue 61, and Nipex carbon black. Pigment Violet 23 is represented by the symbol V, Pigment Blue 61 is represented by the symbol B, and Nipex carbon black is represented by the symbol K. The symbol C, represents chroma, and the symbol h, represents hue. L*, a*, b* are the CIE (Commission Internationale de L'eclairage) color standards utilized in the modeling. L* defines lightness, a* corresponds to the red/green value, and b* denotes the amount of yellow/blue, which corresponds to the way people perceive color.

The set of equations 10 apply to color samples prepared by using wet deposition techniques. Wet-deposition ('wet-dep') is a technique used for rapidly producing samples of fused xerographic toner without the need for an actual xerographic printer. In this technique, known quantities of an aqueous suspension of toner (e.g., ~150-400 mg/L) are filtered through a nitrocellulose filter membrane using a filtration cup. After filtration, the filter membrane is dried, leaving a round patch of deposited toner at a known toner mass per area (TMA). The filter membrane is then protected with Mylar and passed through a laminator to fuse the toner to the membrane, providing a smooth and very glossy image. This color sample can be read in a spectrophotometer to provide CIELAB color values.

Statistical analysis of wet-deps made using mixtures of toners containing either Pigment Violet 23, Pigment Blue 61, or Nipex carbon black dispersion, yield the equations shown in FIG. 1, which fit the observed data with $R^2>0.98$ in all cases, where R is the correlation coefficient of regression. The variables V, B, and K refer to the equivalent amounts of Pigment Violet 23, Pigment Blue 61 and Nipex carbon black deposited on the wet dep, expressed in mg/cm$^2$, and are valid for $0.0099 \leqq V \leqq 0.0171$, $0 \leqq B < 0.00225$, and $0 \leqq K \leqq 2.25 \times 10^4$. In alternative embodiments, it may be advantageous to replace a* and b* by the chroma value C and the hue angle h.

With reference to FIG. 2, a three-dimensional representation graph 20 of the relationship of the CIELAB chroma (C) to loadings of Pigment Violet 23 and Pigment Blue 61 in a toner in accordance with the present disclosure deposited at 0.45 mg/cm$^2$, is presented.

The relationships between these variables can be visualized by plotting them in three dimensions as seen in graph 20. Graph 20 includes a chroma, C, axis 22, a Pigment Violet 23 loading axis 24, and a Pigment Blue 61 loading axis 26. FIG. 2 shows the dependence of C on Pigment Violet 23 and Pigment Blue 61 loadings in a hypothetical toner deposited at 0.45 mg/cm$^2$. FIG. 2 was derived by using the set of equations 10 of FIG. 1.

With reference to FIG. 3, a schematic diagram of a three-dimensional representation graph 30 of the relationship of the CIELAB hue (h) to loadings of Pigment Violet 23 and Pigment Blue 61 in a toner in accordance with the present disclosure deposited at 0.45 mg/cm$^2$ is presented.

The relationships between these variables can be visualized by plotting them in three dimensions as seen in graph 30. Graph 30 includes a hue axis 32, a Pigment Violet 23 loading axis 34, and a Pigment Blue 61 loading axis 36. FIG. 3 shows the dependence of hue on Pigment Violet 23 and Pigment Blue 61 loadings in a hypothetical toner deposited at 0.45 mg/cm$^2$. FIG. 3 was derived by using the set of equations 10 of FIG. 1.

Figures 4, 5:
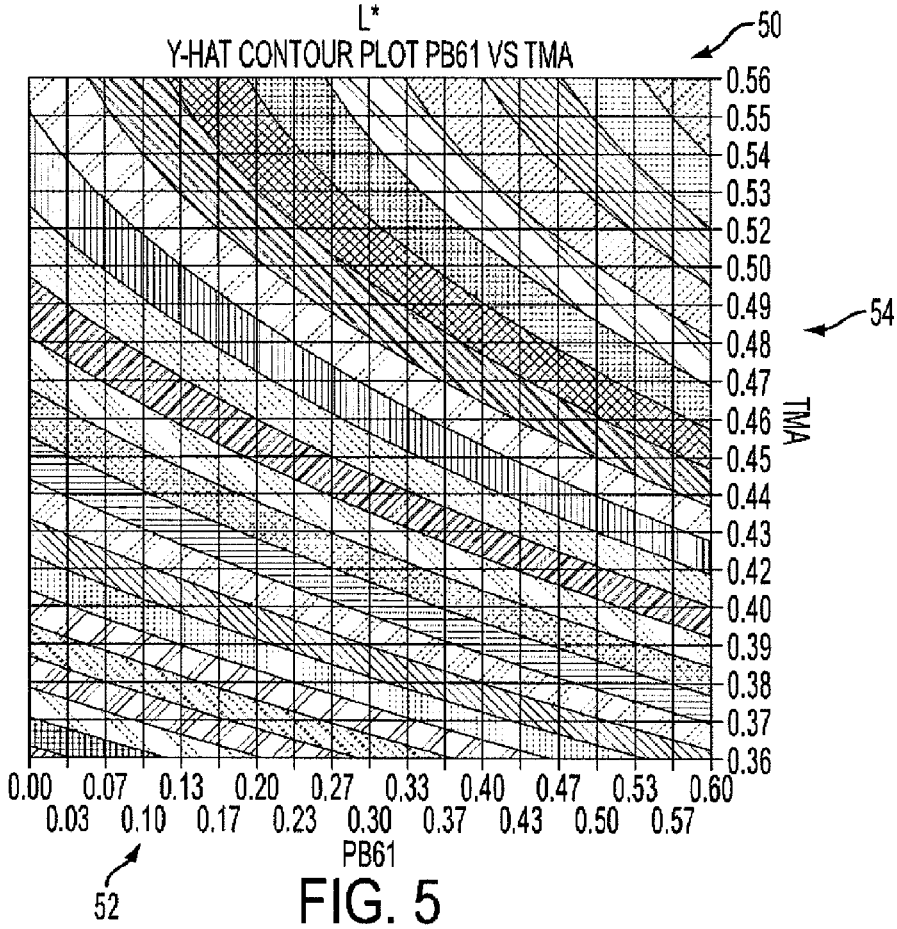
FIG. 4 is a set of equations that represent predicted color values for violet toners in accordance with the present disclosure using a xerographic printing technique.
FIG. 5 is a contour plot of L* as a function of Pigment Blue 61 and toner mass per area (TMA), for a toner of the present disclosure.

With reference to FIG. 4, a set of equations 40 that represent predicted color values for violet toners using a xerographic printing technique is presented.

The set of equations 40 illustrate a relationship between Pigment Blue 61, and TMA. Pigment Blue 61 is represented by the symbol B' and TMA is represented by the symbol m. The symbol, C, represents chroma and the symbol, h, represents hue. L*, a*, b* are the CIE (Commission Internationale de L'eclairage) color standards utilized in the modeling. L* defines lightness, a* corresponds to the red/green value and b* denotes the amount of yellow/blue, which corresponds to the way people perceive color.

Sample xerographic prints were made at varying TMA (e.g., 0.36, 0.46 and 0.56 mg/cm$^2$) using toners containing varying quantities of Pigment Blue 61 (0%, 0.3% and 0.6%) and a fixed quantity of Pigment Violet 23 (3.46%). Machine prints were made with a WCP3545 printer on the digital color elite gloss papers (DCEG). Statistical analysis of the color values for these machine prints provides the following equations for L*, a*, b*, C and h, with $R^2$ equal to 0.98, 0.95, 0.89, 0.79 and 0.99 respectively. The set of equations 40 are valid for the two factors in the ranges studied, i.e., $0 \leqq B' \leqq 0.6$ and $0.36 \leqq m \leqq 0.56$.

With reference to FIG. 5, a contour plot 50 of L* as a function of Pigment Blue 61 and toner mass per area (TMA) is presented. To illustrate the dependence of these color parameters on Pigment Blue 61 and TMA, FIG. 5 gives the contour plot 50 of L* as functions of these two factors. The x-axis 52 represents the Pigment Blue 61 and the y-axis 54 represents the TMA.

Figure 6:
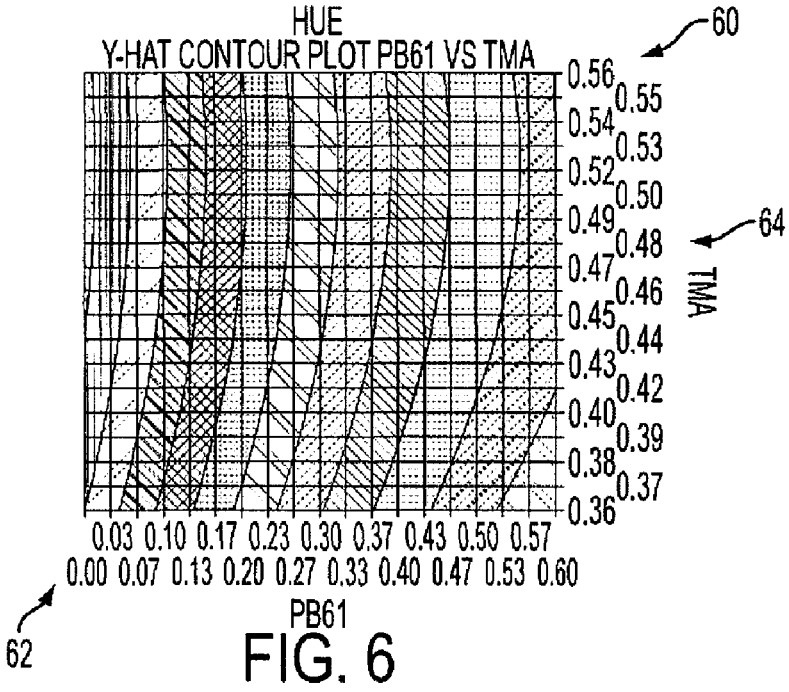
FIG. 6 is a contour plot of hue as a function of Pigment Blue 61 and toner mass per area (TMA), for a toner of the present disclosure.

With reference to FIG. 6, a contour plot 60 of hue as a function of Pigment Blue 61 and toner mass per area (TMA) is presented.

To illustrate the dependence of these color parameters on Pigment Blue 61 and TMA, FIG. 6 gives the contour plot 60 of Hue as functions of these two factors. The x-axis 62 represents the Pigment Blue 61 and the y-axis 64 represents the TMA.

Figure 7:
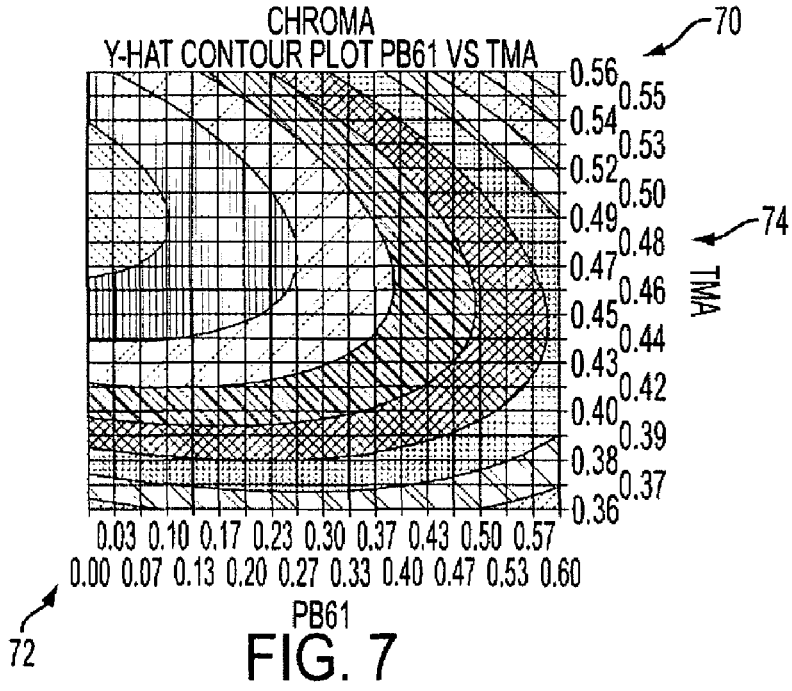
FIG. 7 is a contour plot of chroma as a function of Pigment Blue 61 and toner mass per area (TMA), for a toner of the present disclosure.

With reference to FIG. 7, a contour plot 70 of chroma as a function of Pigment Blue 61 and toner mass per area (TMA) is presented. To illustrate the dependence of these color parameters on Pigment Blue 61 and TMA, FIG. 7 gives the contour plot 70 of Chroma as functions of these two factors. The x-axis 72 represents the Pigment Blue 61 and the y-axis 74 represents the TMA.

With reference to FIG. 8, a set of equations 80 that represent unit interconversion for data analysis of the set of equations of FIG. 4 is presented. The set of equations 80 illustrate a relationship between Pigment Blue 61, and Pigment Violet 23. Pigment Blue 61 is represented by the symbol b' and Pigment Violet is represented by the symbol v'.

In general, it is more practical to relate all the color parameters with the actual pigment density (TMA×loading) instead of TMA, because the actual pigment density defines the color. For simplicity, the pigment density of Pigment Blue 61 is defined as b' and the pigment density of Pigment Violet 23 is defined as v', and (b', v') is used as two new input variables.

Here B'/100 is used to convert B' to actual percentage: b' goes from 0 to 0.6%×0.456 mg/cm$^2$=2.736 ug/cm$^2$, where 0.456 mg/cm$^2$ is from the mathematical optimization for matching PANTONE® violet; and v' goes from 3.46%×0.36 mg/cm$^2$=12.456 ug/cm$^2$ to 3.46%×0.56 mg/cm$^2$=19.376 ug/cm$^2$. By plugging the above data into the set of equations 80, one obtains the color parameters as functions of Pigment Blue 61 density (b') and Pigment Violet 23 density (v') as shown in the set of equations 90 of FIG. 9.

With reference to FIG. 9, a set of equations that represent predicted color values for violet toners based on pigment densities using xerographic printing is presented. The set of equations 90 illustrate a relationship between the densities of Pigment Violet 23 and Pigment Blue 61. Pigment Violet 23 density is represented by the symbol v' and Pigment Blue 61 density is represented by the symbol b'. The symbol C, represents chroma, and the symbol h, represents hue. L*, a*, b* are the CIE (Commission Internationale de L'eclairage) color standards utilized in the modeling. L* defines lightness, a* corresponds to the red/green value and b* denotes the amount of yellow/blue, which corresponds to the way people perceive color.

Once again, B'/100 is used to convert B' to actual percentage: b' goes from 0 to 0.6%×0.456 mg/cm$^2$=2.736 ug/cm$^2$, where 0.456 mg/cm$^2$ is from the mathematical optimization for matching PANTONE® violet; and v' goes from 3.46%×0.36 mg/cm$^2$=12.456 ug/cm$^2$ to 3.46%×0.56 mg/cm$^2$=19.376 ug/cm$^2$.

Figure 10:
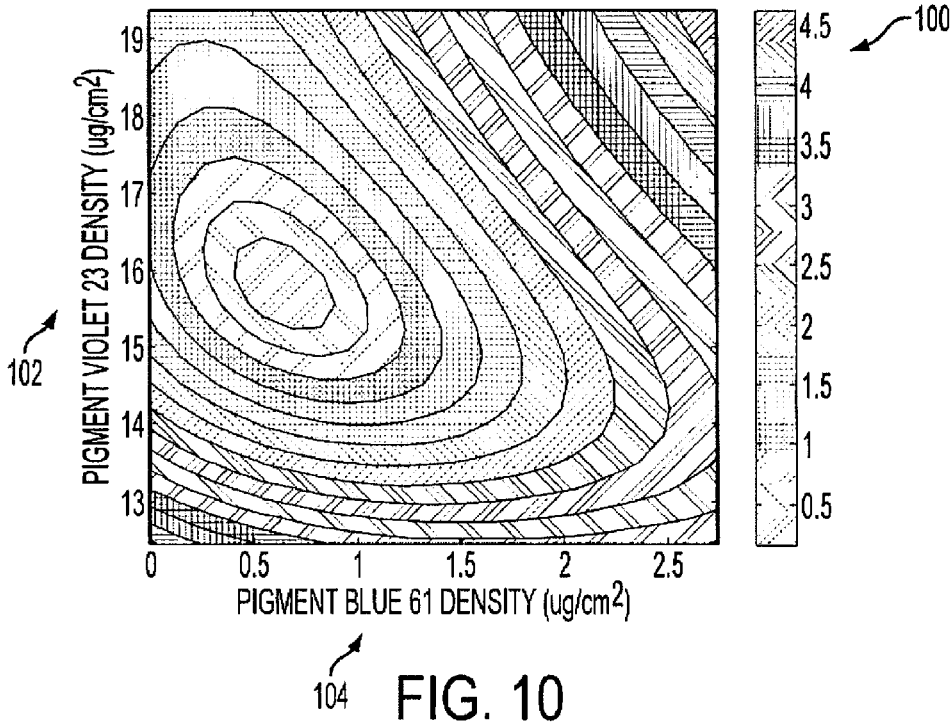
FIG. 10 is a contour plot of $\Delta E_{2000}$ as a function of Pigment Blue 61 density and Pigment Violet 23 density, for a toner of the present disclosure.

With reference to FIG. 10, a contour plot 100 of $\Delta E_{2000}$ as a function of Pigment Blue 61 density and Pigment Violet 23 density.

After a set of (L*, a*, b*) is obtained for any particular set of (b', v'), one can calculate its color difference compared with PANTONE® Violet (L*, a*, b*) =(24.02, 48.98, −64.39) to determine how close the color printing system (or color space) matches the PANTONE® color space with that particular set of pigment density. With a MATLAB® program, the $\Delta E_{2000}$ plot 100 can be calculated as a function of b' and v' as shown in FIG. 10. FIG. 10 illustrates that a wide range of pigment density combinations may be derived, which can match the machine prints with PANTONE® violet with $\Delta E_{2000}<3$. Thus, the sets of equations of the exemplary embodiments establish a satisfactory relationship between Pigment Violet 23 and Pigment Blue 61 in order to match a PANTONE® color space.

Figure 11:
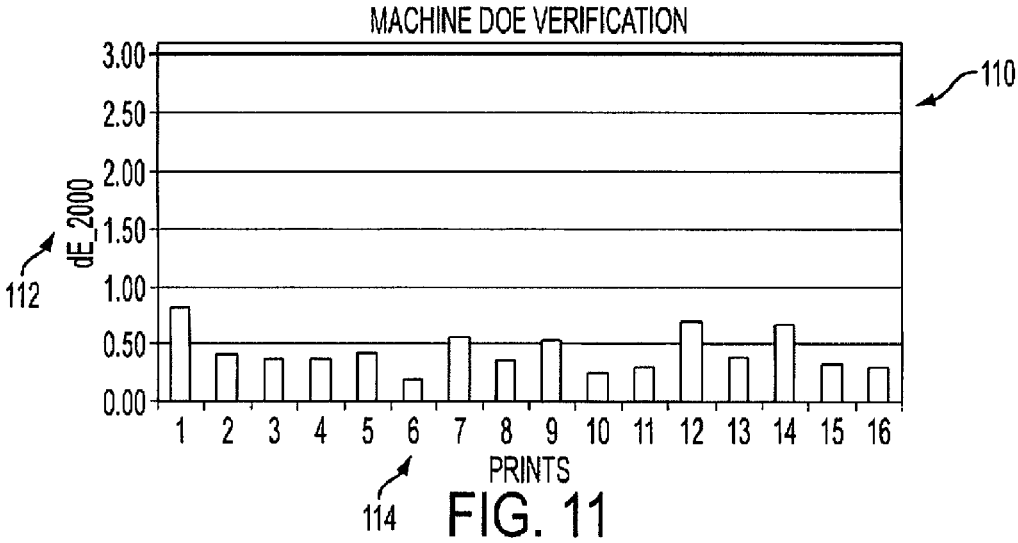
FIG. 11 is a plot depicting a comparison between PANTONE® violet and a violet in accordance with the present disclosure.

With reference to FIG. 11, a plot 110 depicting a comparison between PANTONE® violet and a violet in accordance with the present disclosure is presented. The machine DOE verification graph 110 includes a $\Delta E_{2000}$ y-axis 112 and a prints axis 114.

The present disclosure further specifies a toner pigment loading to toner color relationship that defines a violet and blue pigment set, from which can be selected compositions that have a good color match to PANTONE® Violet.

Also, the embodiments of the present disclosure propose a violet toner with at least two pigments where the violet pigment amount and the blue pigment amount on the paper satisfy the CIELAB color equations defined as Equations 10 (for 'wet deps') and Equations 90 (for xerographic prints) within a $\Delta E_{2000}$ of 2.

Moreover, embodiments of the present disclosure provide a violet toner with at least two pigments where the amounts of Pigment Violet 23 and Pigment Blue 61 on the paper satisfy the CIELAB color equation defined as Equations 10 (for 'wet deps') and Equations 90 (for xerographic prints) within a $\Delta E_{2000}$ of 2.

Furthermore, embodiments of the present disclosure provide a violet toner with a TMA of greater than or equal to 0.36 and less than or equal to 0.56 with at least two pigments where the blue pigment loading and the TMA in the toner satisfy the CIELAB color equation defined as Equations 40 for xerographic prints within a $\Delta E_{2000}$ of 2.

Wax

In addition to the polymer binder resin and colorants described above, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Where utilized, the wax may be combined with the resin in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin(s). The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1 parts per hundred (pph) to about 1 pph, in embodiments from about 0.25 pph to about 0.75 pph, in some embodiments about 0.5 pph. This provides a sufficient amount of agent for aggregation.

The gloss of a toner may be influenced by the amount of retained metal ion, such as A13+, in the particle. The amount of retained metal ion may be further adjusted by the addition of EDTA. In embodiments, the amount of retained crosslinker, for example A13+, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

In embodiments, the aggregate particles may be of a size of less than about 3 microns, in embodiments from about 2 microns to about 3 microns, in embodiments from about 2.5 microns to about 2.9 microns.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration. In some embodiments, a low molecular weight amorphous resin may be utilized to form a shell over the formed aggregates.

The shell resin may be present in an amount of from about 10 percent to about 32 percent by weight of the toner particles, in embodiments from about 24 percent to about 30 percent by weight of the toner particles.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter D50v, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −5 μC/g to about −90 μC/g , and a final toner charging after surface additive blending of from −15 μC/g to about −80 μC/g Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 2.5 to about 20 μm, in embodiments from about 2.75 to about 10 μm, in other embodiments from about 3 to about 7.5 μm.

(2) Number Average Geometric Standard Deviation (GSDn) and/or Volume Average Geometric Standard Deviation (GSDv) of from about 1.18 to about 1.30, in embodiments from about 1.21 to about 1.24.

(3) Circularity of from about 0.9 to about 1 (measured with, for example, a Sysmex FPIA 2100 analyzer), in embodiments form about 0.95 to about 0.985, in other embodiments from about 0.96 to about 0.98.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may ten be cooled and thereafter classified to a desired particle size.

In embodiments, suitable carriers may include a steel core, for example of from about 25 to about 100 μ, in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser member. The fusing member can be of any desired or suitable configuration, such as a drum or roller, a belt or web, a flat surface or platen, or the like. The fusing member can be applied to the image by any desired or suitable method, such as by passing the final recording substrate through a nip formed by the fusing member and a back member, which can be of any desired or effective configuration, such as a drum or roller, a belt or web, a flat surface or platen, or the like. In embodiments, a fuser roll can be used. Fuser roll members are contact fusing devices that are within the purview of those skilled in the art, in which pressure from the roll, optionally with the application of heat, may be used to fuse the toner to the image-receiving medium. Optionally, a layer of a liquid such as a fuser oil can be applied to the fuser member prior to fusing.

In embodiments, a suitable electrostatographic apparatus for use with a toner of the present disclosure may include a housing defining a chamber for storing a supply of toner therein; an advancing member for advancing the toner on a surface thereof from the chamber of said housing in a first direction toward a latent image; a transfer station for transferring toner to a substrate, in embodiments a flexible substrate, the transfer station including a transfer assist member for providing substantially uniform contact between said print substrate and the image-retentive member; a developer unit possessing toner for developing the latent image; and a fuser member for fusing said toner to said flexible substrate.

Traditionally, color printers have used four housings to generate full-color images based on black plus the standard printing colors cyan, magenta, and yellow. This four-color printing system is able to print a wide range of hues with generally good results. However, in embodiments additional housings may be desirable, including printers possessing five housings, six housings, or more, thus giving it the ability to print an extended range of colors (extended gamut). For example, a six housing system could include orange and violet as priority colors for the additional two housings.

With printer platforms with additional color housings, it may be desirable that the newly introduced colors (i.e., orange and violet) be matched to the equivalent PANTONE® standard primaries (PANTONE® Orange and PANTONE® Violet) due to the prevalence of the PANTONE® system in the printing and graphic-arts industries.

With respect to the present disclosure, the pigments, or mixtures of pigments selected for each toner are noteworthy, and the combination set, or gamut of toners, such as the cyan toner, the magenta toner, the orange toner, the violet toner, the yellow toner, and the black toner, as it is with these pigments, their sizes, and processes thereof that there is enabled the advantages of the present disclosure illustrated herein and including excellent stable triboelectric characteristics, acceptable stable admix properties, superior color resolution, the capability of obtaining any colors desired, that is a full color gamut, for example thousands of different colors and different developed color images, substantial toner insensitivity to relative humidity, toners that are not substantially adversely affected by environmental changes of temperature, humidity, and the like, the provision of separate unmixed toners, such as black, cyan, magenta, yellow, orange, and violet toners, and mixtures thereof with the advantages illustrated herein, and which toners can be selected for the multicolor development of electrostatic images. The specific selection of colored toners with exceptionally well dispersed pigments enables a large color gamut which assures that thousands of colors can be produced.

Also, embodiments of the present disclosure may include a xerographic imaging and printing apparatus comprised in operative relationship of at least an imaging member component, a charging component, six development components, a transfer component, and a fusing component, and wherein said development components include therein carrier and six color toners, respectively, and wherein the six toners are comprised of a cyan toner, a magenta toner, a yellow toner, an orange toner, a violet toner, and a black toner, as illustrated herein, respectively, each of said toners being comprised, for example, of resin and pigment, and wherein the pigments for each toner are as illustrated herein, and wherein in embodiments said developer components are comprised of six separated housings, and wherein one housing contains the cyan toner, the second housing contains a magenta toner, the third housing contains the yellow toner, the fourth housing contains the black toner, the fifth housing contains the orange toner, and the sixth housing contains the violet toner, each of said toners being comprised of resin and pigment.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

Prediction of chroma and hue in a 'wet-dep' sample. Multiple-response optimization with the SigmaZone DOE PRO XL software package predicted that chroma in 'wet-deps' of a violet toner was near its maximum (see FIG. 1) when V=0.01557 mg/cm$^2$, B=0.00135 mg/cm$^2$ and K=0 mg/cm$^2$. The DOE PRO XL software package is commercially available from SigmaZone, and provides for experimental design, analysis and optimization. Entering these values into Equations 10 for 'wet-dep' samples predicted C=87.1 and h=307.2. A styrene-acrylate emulsion-aggregation toner was prepared using 3.46% Pigment Violet 23 and 0.30% Pigment Blue 61 and deposited on a nitrocellulose filter membrane at 0.45 mg/cm. Measurement of CIELAB values gave C=87.7 and h=306.9 for this sample.

A comparison of the model prediction for this toner, with the actual CIELAB values observed, resulted in $\Delta E_{2000}$=0.50, meaning the difference between the predicted and observed results was not detectable to the human eye.

Example 2

Matching PANTONE® violet with machine prints. Multiple-response optimization with the SigmaZone DOE PRO XL software package suggested that violet machine prints produced with a violet toner of the present disclosure matched PANTONE® violet, when Pigment Blue 61 loading was 0.144% and TMA was 0.456 mg/cm$^2$, with Pigment Violet 23 loading of about 3.46%. To match the color at the target TMA of about 0.45 mg/cm$^2$, pigment loadings in the toners were adjusted to 0.146% (Pigment Blue 61) and 3.5% (Pigment Violet 23). A styrene-acrylate emulsion-aggregation toner was prepared based on this formulation and 16 machine prints were generated in order to verify this model. It was found that the $\Delta E_{2000}$ of these 16 prints were less than 0.8, with half of them less than 0.4, much less than the human perception limit of 3 ($\Delta E_{2000}$) as shown in FIG. 11. This meant that the predictive equations successfully produced a pigment formulation for matching violet toners of the present disclosure with PANTONE® violet.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A violet toner, comprising: at least one resin; an optional wax; and a colorant system comprising a violet pigment selected from the group consisting of Pigment Violet 23, Pigment Violet 3, and combinations thereof, in combination with a blue pigment selected from the group consisting of Pigment Blue 61, Pigment Blue 15:3, and combinations thereof, wherein the blue pigment is present in an amount of about 0.1 to about 5 percent by weight of the colorant system, and wherein the violet toner matches the color of Pantone violet within a human perception limit ($\Delta E_{2000}$) of less than about 3.

2. The violet toner of claim 1, wherein the at least one resin comprises styrenes, acrylates, methacrylates, butadienes, isoprenes, acrylic acids, methacrylic acids, acrylonitriles, and combinations thereof.

3. The violet toner of claim 1, wherein the at least one resin comprises at least one amorphous polyester resin, optionally in combination with at least one crystalline polyester resin.

4. The violet toner of claim 1, wherein the violet pigment is present in an amount from about 0.5 to about 10 percent by weight of the colorant system.

5. The violet toner of claim 1, wherein the colorant system further comprises a black pigment selected from the group consisting of carbon black, magnetite, aniline black, manganese oxide, lamp black, iron oxide, and combinations thereof in an amount of from about 0 to about 5percent by weight of the colorant system.

6. The violet toner of claim 1, wherein the colorant system is present in an amount from about 1 to about 15 percent by weight of the toner, and wherein the toner has a target mass per unit area of from about 0.2 mg/cm$^2$ to about 1.5 mg/cm$^2$.

7. The violet toner of claim 1, wherein the wax is present in an amount of from about 1 weight percent to about 25 weight percent of the toner particles.

8. The violet toner according to claim 1, wherein particles comprising the toner are of a size of from about 2.5 microns to about 20 microns.

9. A violet toner, comprising: at least one resin comprising at least one amorphous polyester resin in combination with at least one crystalline polyester resin; a wax; and a colorant system comprising a violet pigment selected from the group consisting of Pigment Violet 23, Pigment Violet 3, and combinations thereof, in combination with a blue pigment selected from the group consisting of Pigment Blue 61, Pigment Blue 15:3, and combinations thereof, wherein the blue pigment is present in an amount of about 0.1 to about 5 percent by weight of the colorant system , and wherein the violet toner matches the color of Pantone violet within a human perception limit ($\Delta E_{2000}$) of less than about 3.

10. The violet toner of claim 9, wherein the at least one amorphous polyester resin is of the formula:

(I)

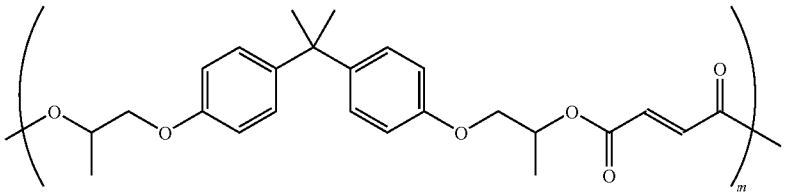

wherein m may be from about 5 to about 1000, and the crystalline polyester resin is of the formula:

(II)

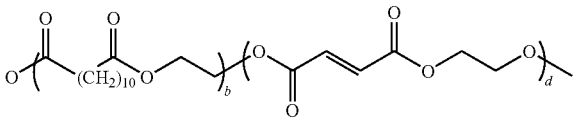

wherein b is from about 5 to about 2000 and d is from about 5 to about 2000.

11. The violet toner of claim 9, wherein the violet pigment is present in an amount from about 0.5 to about 10 percent by weight of the colorant system.

12. The violet toner of claim 9, wherein the colorant system further comprises a black pigment selected from the group consisting of carbon black, magnetite, aniline black, manganese oxide, lamp black, iron oxide, and combinations thereof in an amount of from about 0 to about 5percent by weight of the colorant system.

13. The violet toner of claim 9, wherein the colorant system is present in an amount from about 1 to about 15 percent by weight of the toner.

14. The violet toner of claim 9, wherein the toner has a target mass per unit area of from about 0.2 mg/cm$^2$ to about 1.5 mg/cm$^2$.

15. The violet toner of claim 9, wherein the wax is present in an amount of from about 1 weight percent to about 25 weight percent of the toner particles.

16. The violet toner according to claim 9, wherein particles comprising the toner are of a size of from about 2.5 microns to about 20 microns.

17. A method comprising: contacting at least one resin and at least one surfactant to form an emulsion; contacting the emulsion with an optional wax, and a colorant system comprising a violet pigment selected from the group consisting of Pigment Violet 23, Pigment Violet 3, and combinations thereof, present in an amount of from about 0.5 to about 10 percent by weight of the toner, in combination with a blue pigment selected from the group consisting of Pigment Blue 61, Pigment Blue 15:3, and combinations thereof, present in an amount of about 0.1 to about 5 percent by weight of the colorant system, to form a primary slurry; aggregating the at least one resin and the colorant system with an aggregating agent to form aggregated particles; coalescing the aggregated particles to form toner particles; and recovering the toner particles, wherein the violet toner matches the color of Pantone violet within a human perception limit ($\Delta E_{2000}$) of less than about 3.

18. The method according to claim 17, wherein pigment loading of the colorant system may be determined using a set of predictive equations selected from the group consisting of $$L^*67.944-794.085b'-4360.288v'-40206.81b'v'+103652.9v'^2$$

$$a^*=18.047-1019.745b'+3795.321v'116931.9b'v'+165197.7b'^2108599.9v'^2$$

$$b^*-34.019-4890.829b'-3432.858v'+173103.5b'v'+470681.2b'^2+99665.6v'^2$$

$$C=38.210+3311.211b'+5003.37v'-212911b'v'-246329.7b'^2-144155.6v'^2$$

$$h=301.867-2547.608b'+784.664v'+280042.6b'^{2-}21842.4v'^2$$

and combinations thereof, wherein L* defines lightness, a* denotes the amount of red/green, b* denotes the amount of yellow/blue, C is chroma, h is hue, b' is the pigment density of the blue pigment, and v' is the pigment density of the violet pigment.

19. The method according to claim 17, wherein the at least one resin comprises at least one polyester resin optionally in combination with at least one crystalline resin, and wherein the colorant system further comprises a black pigment selected from the group consisting of carbon black, magnetite, aniline black, manganese oxide, lamp black, iron oxide, and combinations thereof in an amount of from about 0 to about 5 percent by weight of the colorant system.

20. The method according to claim 19, wherein pigment loading of the colorant system may be determined using a set of predictive equations selected from the group consisting of $$L^*=67.367-4365V-4979B+201.7K+1.681\times10^5VB-1.388\times10^7V-BK+1.007\times10^5V^2+4.199\times10^5B^2$$

$$a^*=21.842+4373V-4563B-2.863\times10^4K+1209\times10^5VB+8.018\times10^6VK+6.373\times10^7VBK-1.414\times10^5V^2+3.513\times10^5B^2+2.249\times10^7K^2$$

$$b^*=-41.530-3124V-5184B+2.662\times10^4K+1.836\times10^5VB-8.760\times10^5VK-5.078\times10^7VBK+9.723\times10^4V+2.609\times10^5B^2$$

$$C=46.134-5161V+1585B-4.053\times10^4K-8.760\times10^5VB+1.165\times10^6VK+8.169\times10^7VBK-1.637\times10^5V^2+2.347\times10^7K^2$$

$$h=301.82+1113V-4746B-2129K+1.476\times10^6VB-2.449\times10^6BK+-1.489\times10^9VBK-3.802\times10^4V^2+3.271\times10^5B^2+8.345\times10^6K^2$$

and combinations thereof, wherein L* defines lightness, a* denotes the amount of red/green, b* denotes the amount of yellow/blue, C is chroma, h is hue, V is the amount of violet pigment in mg/cm$^2$, B is the amount of blue pigment in mg/cm$^2$, and K is the amount of black pigment in mg/cm$^2$.

* * * * *